US008388406B2

(12) United States Patent
Liu

(10) Patent No.: US 8,388,406 B2
(45) Date of Patent: Mar. 5, 2013

(54) BRASSIERES

(75) Inventor: Zhen Qiang Liu, Kwai Chung (HK)

(73) Assignee: Regina Miracle International Limited, Kwai Chung (HK)

( * ) Notice: Subject to any disclaimer, the term of this patent is extended or adjusted under 35 U.S.C. 154(b) by 1175 days.

(21) Appl. No.: 12/202,668

(22) Filed: Sep. 2, 2008

(65) Prior Publication Data

US 2010/0056022 A1 Mar. 4, 2010

(51) Int. Cl.
*A41C 3/00* (2006.01)

(52) U.S. Cl. ..... 450/39; 450/54

(58) Field of Classification Search ..... 450/92, 450/93, 1, 37, 38, 39, 54–58; 2/267, 268
See application file for complete search history.

(56) References Cited

U.S. PATENT DOCUMENTS

| | | | | |
|---|---|---|---|---|
| 2,727,278 | A * | 12/1955 | Thompson | 264/46.4 |
| 3,202,565 | A * | 8/1965 | Loftin | 428/175 |
| 4,375,445 | A * | 3/1983 | Cole et al. | 264/250 |
| 4,481,951 | A * | 11/1984 | Cole et al. | 450/20 |
| 6,398,620 | B1 * | 6/2002 | Huang | 450/57 |
| 6,805,612 | B1 | 10/2004 | Luk | |
| 7,192,332 | B2 * | 3/2007 | Liu | 450/39 |
| 7,198,540 | B2 * | 4/2007 | Liu | 450/39 |
| 7,252,574 | B2 * | 8/2007 | Chen | 450/38 |
| 7,407,427 | B2 * | 8/2008 | Liu | 450/39 |
| 7,563,152 | B2 * | 7/2009 | Liu | 450/39 |

* cited by examiner

*Primary Examiner* — Gloria Hale
(74) *Attorney, Agent, or Firm* — Gilman Pergament LLP

(57) ABSTRACT

A breast cup for a bra that has an outermost layer and an innermost layer and at least one intermediate panel that is captured between the innermost layer and the outermost layer. At least part of an edge of the intermediate panel is positioned at a location that is non-contiguous the perimeter of the cup. This defines within the cup perimeter at least two zones of different cross sectional composition that may offer a different hand feel of different parts of the cup.

44 Claims, 9 Drawing Sheets

BRASSIERES

FIELD OF THE INVENTION

The present invention relates to improvements to brassieres.

BACKGROUND

Brassieres (hereinafter "bra") are items of clothing that to many wearers are quite personal items. Their selection for purchase is primarily influenced by factors such as the comfort and support the bra provides the wearer. However many models of bras come in varying sizes to accommodate a range of such factors. Other factors that may influence the purchase of a bra are the aesthetic shape of the bra, the purpose for which it may be worn, and the bra color. The way a bra feels may also influence the purchase of a bra. Bra's come in many different materials. Lace, spandex, polyester are all materials that may be used in the construction of a bra. These materials all present a different tactile feel to the bra. Such is a superficial contact characteristic. It may be desirable for a bra to have other characteristics that can be felt, that are not superficial, in order to provide a user with a product that offers different or further factors that may appeal to them.

It is therefore an object of the present invention to provide a brassiere that has zones of different feel that will at least provide the public with a useful choice.

BRIEF DESCRIPTION OF THE INVENTION

Accordingly in a first aspect the present invention consists bra that includes two breast cups that each include an outermost layer and an innermost layer, wherein at at least one breast cup, at least one intermediate panel is captured between the inner most layer and the outer most layer, and at least part of an edge of the intermediate panel is positioned at a location that is non-contiguous the perimeter of the cup to define within the cup perimeter at least two zones of different cross sectional composition.

Preferably at least the neckline perimeter of the at least one breast cup is defined at least by one of the outermost layer and innermost layer.

Preferably the innermost layer is laminated to a foam layer that is proximate more the outermost layer than the innermost layer.

Preferably the innermost layer and foam layer are coextensive.

Preferably the outermost layer is laminated to a foam layer that is proximate more the innermost layer than the outermost layer.

Preferably the outermost layer and second mentioned foam layer are coextensive.

Preferably the innermost layer is laminated to the outermost layer at regions save for where the intermediate panel is located.

Preferably the first mentioned foam layer is laminated to the outermost layer at regions save for where the intermediate panel is located.

Preferably the second mentioned foam layer is laminated to the innermost layer at regions save for where the intermediate panel is located.

Preferably the at least part of the edge of the intermediate panel extends or generally extends between (and preferably to and from) the neckline perimeter of the cup and the side perimeter of the cup.

Preferably the at least part of the edge of the intermediate layer extends or generally extends between (and preferably to and from) the neckline perimeter of the cup and the base perimeter of the cup.

Preferably the at least part of the edge of the intermediate layer extends or generally extends between (and preferably to and from) the side perimeter of the cup and the base perimeter of the cup.

Preferably at least one of the outermost and innermost layers comprises of at least two panels that correspond to or substantially align with the at least two zones of the at least one breast cup.

Preferably the at least two panels are at least in part joined to each other by ultrasonic welding.

Preferably at least one of the outermost and innermost layers comprises of at least two panels that define a boundary between said two panels that at least in part corresponds to or substantially aligns with at least part of the boundary of the at least two zones of the cup.

Preferably at least one of the outermost and innermost layers comprises of at least two panels that define a boundary between said two panels that corresponds to or substantially aligns with the boundary of the at least two zones of the cup.

Preferably both the innermost layer and the foam layer with which its laminated, each comprises of at least two panels that define a boundary between said two panels that at least in part corresponds to or substantially aligns with at least part of the boundary of the at least two zones of the cup.

Preferably both the outermost layer and the foam layer with which its laminated, each comprises of at least two panels that define a boundary between said two panels that at least in part corresponds to or substantially aligns with at least part of the boundary of the at least two zones of the cup.

Preferably the panels of the innermost layer and/or outermost layer and/or foam layers with which they are laminated are butt joined.

Preferably the panels of the innermost layer and/or outermost layer and/or foam layers with which they are laminated are joined in an overlapping manner.

Preferably the innermost layer and outermost layer are coextensive each other.

Preferably the inner most layer is a fabric layer.

Preferably the outer most layer is a fabric layer.

Preferably the intermediate panel is a panel of a material selected from one of foam, fabric and polyolefin.

Preferably there are at least two intermediate panels.

Preferably the at least two intermediate panels do not overlap each other.

Preferably each of the at least two intermediate panels are of a different characteristic (such as shape, thickness, material, composition, construction, color, texture, profile and/or density).

Preferably at least two of the panels defining the outermost layer are of a different characteristic (such as shape, thickness, material, composition, construction, color, texture, profile and/or density).

Preferably the at least one breast cup has lower region and an upper region, the lower region being having a harder hand feel than the upper region.

Preferably the lower region extends or generally extends from the base perimeter of the cup towards the neckline of the cup.

Preferably the upper region extends or generally extends from the neckline perimeter of the cup towards the base perimeter of the cup.

Preferably there is an intermediate region of the at least one breast cup having a hand feel that is intermediate that of the upper region and the lower region.

Preferably the intermediate region substantially separates the upper region and lower region.

Preferably the intermediate region extends or generally extends from the side perimeter region of the cup.

Preferably the intermediate panel is or comprises a ply of foam that has a thin perimeter region at at least part of the perimeter that is of a reduced thickness compared to other parts of the ply.

Preferably the intermediate panel is or comprises a non-stretch or substantially non-stretch fabric.

Preferably the bra is a molded bra.

Preferably the bra is a seamless bra.

In another aspect the present invention consists in a breast cup for a bra said breast cup comprising an outermost layer and an innermost layer and at least one intermediate panel that is captured between the innermost layer and the outermost layer, wherein at least part of an edge of the intermediate panel is positioned at a location that is non-contiguous the perimeter of the cup to define within the cup perimeter at least two zones of different cross sectional composition.

In another aspect the present invention consists in a method of producing a breast cup for a bra, the method comprising the steps of:

providing an outermost layer, providing an innermost layer, capturing an intermediate panel between the outermost layer and the innermost layer, the intermediate panel captured such that at least part of an edge of the intermediate panel is positioned at a location that is non-contiguous the perimeter of the breast cup so that at least two zones of different cross sectional compositions are defined within the cup perimeter.

Preferably prior to or at the time of capturing the intermediate panel the innermost layer is laminated to a foam layer that is to be positioned adjacent the intermediate panel.

Preferably the innermost layer and foam layer are coextensive.

Preferably prior to or at the time of capturing the intermediate panel the outermost layer is laminated to a second foam layer.

Preferably the outermost layer and innermost layer are shaped and positioned to be coextensive each other.

Preferably at least one of the outermost and innermost layers is formed from a plurality of panels joined together.

Preferably the joining of the plurality of panels is by ultrasonic welding.

Preferably the boundary between two of said panels joined together at least in part corresponds to at least part of the boundary of the two zones of the cup.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

Where reference herein is made to interior and exterior or similar terminology in relation to component parts or items of the bra or part of the bra, it is meant to be understood to be in relation to the body of the wearer of the bra. For example the "interior" or "inner side" or "inner region" is a relative term to denote that an item is more proximate the face side of the bra that is more proximate to the body of the wearer than some or all items of the bra that are more distal the body of the wearer. "Inner" does not necessarily mean "inner most" unless specified. This similarly applies to terms such as "outer" or "exterior".

Where reference herein is made to "upper" or "lower" in relation to a bra or a bra cup, such is in relation to an orientation of the bra or bra cup where the bra or bra cup is in a state of being worn by a wearer in an upright position.

Where there is reference to the word "layer" it is to be understood that it may have its common definition and, but not limited to that the layer could consist of one panel or may have regions that are defined by two or more panels that are joined and that may each be of a different characteristic (e.g. color, thickness, material, orientation, size).

Where there is reference to the word "layer" it is to be understood that it may have its common definition and, but not limited to that the layer may be of one ply or of more plies of the same or dissimilar characteristics (e.g. color, thickness, material, orientation, size) that are engaged to each other such as by lamination or other means in an at least partial overlapping and/or lapping configuration.

Where a seamless bra is mentioned, it is understood to mean that the bra is visibly substantially seamless, in that the edges of the bra are finished in a seamless way, for example by ultrasonic welding, or by folding the edge of an outer layer over and affixing it to an inner layer by a non-stitching means, or by some other means that is substantially without seams. Seams may however be found inside the bra structure where it is not externally visible, or is visibly less conspicuous externally at places such as the region where the shoulder strap is attached to a bra cup region, or the region where hook or eye tape is connected to the chest bands.

Where reference is made to soft or softer hand feel and hard or harder hand feel, this may primarily refer to but is not limited to the elasticity characteristics. Softer feel may mean but is not limited to more elasticity and harder feel may mean but is not limited to less elasticity.

The term "cross sectional composition" refers to the plies of material that may exist at any cross section taken through the cup of the bra. A non-homogenous cross sectional composition is for example one where at any given cross section, there may be different numbers of plies of material at different parts of the cross section. In addition or instead of a different number of plies, there may or may also be different materials, and/or the same materials having different characteristics.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

BRIEF DESCRIPTION OF THE DRAWINGS

A preferred form of the present invention will now be described with reference to the accompanying drawings in which.

DETAILED DESCRIPTION OF THE INVENTION

Figure 1:
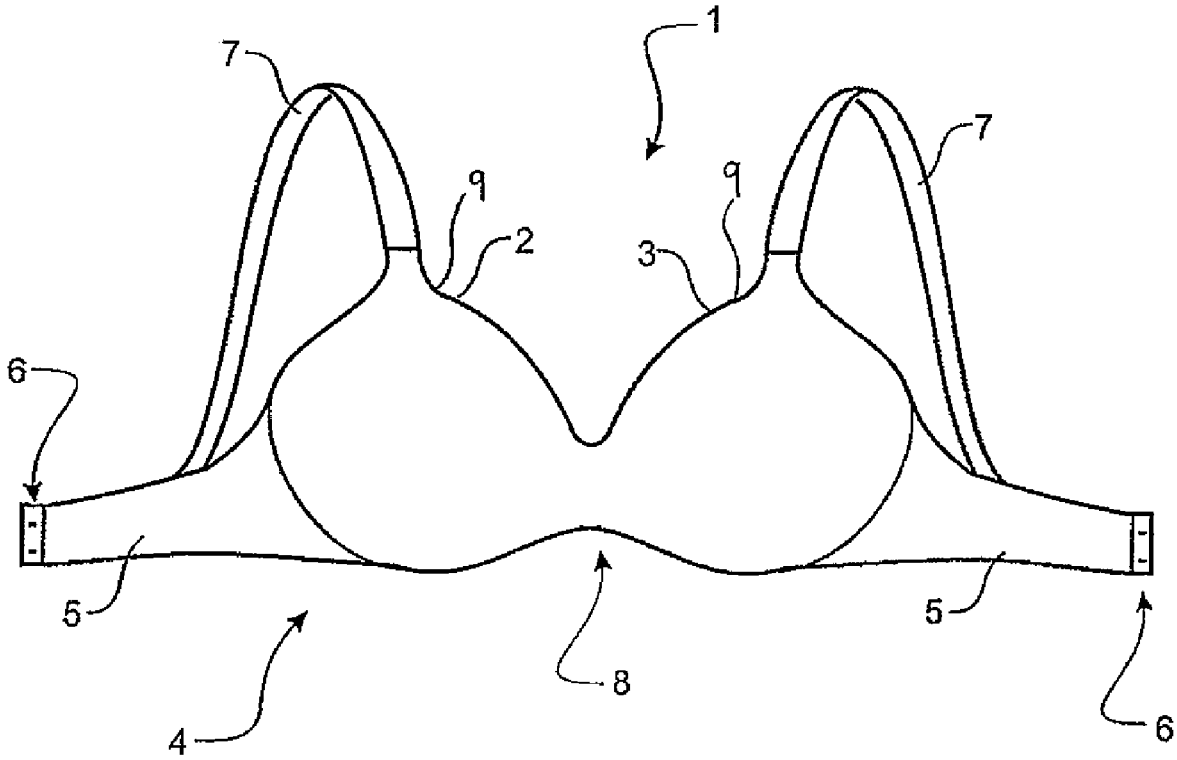
FIG. 1 is a front view of a bra of the present invention.

With reference to FIG. 1 there is shown a bra 4 that may generally be defined by a breast cup region 1, chest bands 5 and shoulder straps 7. The shoulder straps 7 may extend between the breast cup region 1 and each of the chest bands 5.

Such over the shoulder straps may however be optional as it is envisaged that the bra may also be of a strapless version. Indeed whilst reference is herein made to a bra, it is envisaged that the assembly of panels, component, parts and items to define such, may alternatively be incorporated into other garments such as, for example, evening dresses or bathing suits or similar.

At the ends of each of the chest bands may be fasteners 6 that are mutually cooperative to allow for the bra 4 to be fastened about the chest of a wearer.

The bra may be seamless and made from materials at least some of which are molded or moldable and that are engaged to each other preferably at least in part by lamination. Heat and pressure and/or adhesives are generally applied during such lamination. In one preferred form, the bra is a one-piece bra, so that at least the outermost layer and the innermost layer of the bra are each a continuous piece of, for example, fabric layer or layer of any other suitable material.

As can be seen with reference to FIG. 1 the components defining the breast cup region 1 may be fastened to the components defining the chest band 5 and the shoulder strap 7. Such fastening may occur by adhesive and/or ultrasonic welding or other forms of welding and/or by stitching. Stitching is not the preferred form of assembly. In the most preferred form the bra of the present invention is a seamless bra that incorporates little or no stitching at all. With reference to FIG. 1 it can be seen that a bra 4 of the present invention can be made from discrete components such as the breast cups and the chest bands that are, during the manufacture of the bra, fastened together.

The breast cup region 1 preferably defines two breast cups 2 and 3 that are adjacent to each other and between which may extend an intermediate bridge region 8. At least some of the material components defining the breast cups 2 and 3 may be continuous over the entire breast cup region 1, including across the bridge region 8. Alternatively some or all of the material components may only be present at at least part of the breast cups 2 and 3.

In the preferred form, at least one of the layers of the breast cup region 1 is preferably continuous over the breast cup region 1 and preferably also over the bridge region 8. However in alternative forms each of the breast cups 2 and 3 may be separately predefined and may be affixed or joined together at the bridging region 8 to define, once assembled, a breast cup region 1.

The bra includes a neckline perimeter 9 at each of the breast cups 2 and 3. The neckline perimeter 9 may be continuous over the two breast cups or may be discretely defined for each breast cup. The neckline perimeter generally extends from an upper region of each breast cup preferably at where the shoulder straps 7 are engaged to the breast cup, to or towards the bridge region 8. The neckline perimeter 9 as shown in the bra in FIG. 1, is preferably continuous across the neckline perimeter and extends from shoulder strap to shoulder strap. The neckline perimeter 9 generally sits above a substantial part of the breast of the wearer. The neckline is often that part of the bra that is exposed through the likes of the necked tops or shirts. It is also that part of the bra against which clothing may cling or sit tightly against.

Additional components, layers or plies of material may be provided with the materials defining the breast cup region and/or the bra, to those herein defined.

Variations to the bra shown in FIG. 1 may include where the chest bands 5 are unitary and may extend along the lower perimeter of the breast cup region 1. The bra may be a front opening bra where mutually cooperative fasteners are positioned at the bridge region 8 to allow the bra to be opened and fastened at that region.

The bra of the present invention has cups 2 and 3 that comprise zones of different cross sectional compositions and thus may have different tactile and/or elastic characteristics.

FIGS. 2 to 8 show an exemplary manufacturing process of the cups 2 and 3 of the bra of the present invention. It should be appreciated that this process can also be applied to a molded one-piece bra or a unitary breast cup region 1 of a bra.

FIGS. 9 to 13 show cross-sectional views (corresponding to A-A of FIG. 2) each of which correspond with FIGS. 2 to 6 showing the manufacturing process.

Figure 2:
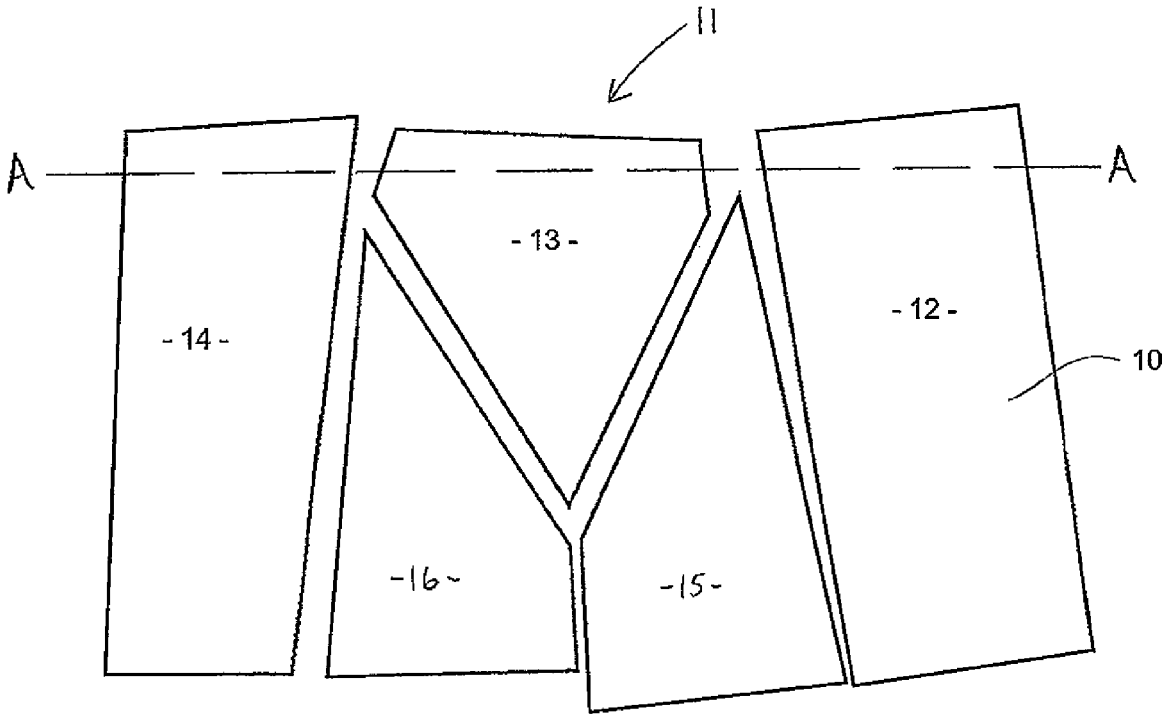
FIG. 2 is a view of five panels of the outer most layer before they are bonded together.
Figure 3:
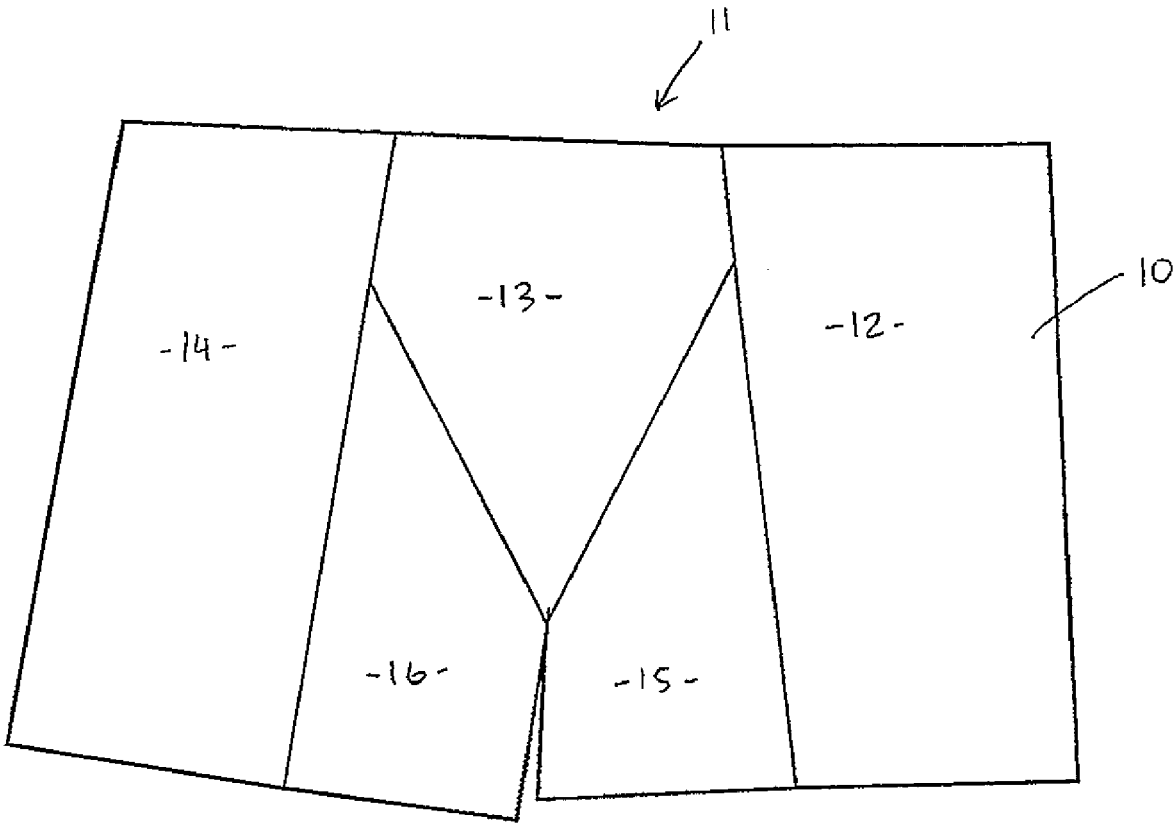
FIG. 3 is a view of the five panels of FIG. 2 after they are bonded together.

FIGS. 2 and 3 show the outer most layer 11 which may be a unitary layer or may comprise multiple panels. The outer most layer is preferably a fabric layer, but may be any other suitable material.

FIG. 2 shows the outer most fabric layer 11 before the panels are joined, and FIG. 3 shows the outer most fabric layer 11 when the panels are joined.

In the preferred embodiment of the invention there are panels 12, 13, 14, 15 and 16 which are joined together. The joints between adjacent panels may be abutting joints or overlapping joints that are preferably ultrasonically welded together. Ultrasonically-welded abutting joints are most preferred since the resultant fabric surface will have the joints visible but still remain smooth. An adhesive may also be used. Sewing may also be an alternative method of joining adjacent panels.

Alternatively, any number of panels may be used to form the outer most layer 11. Preferably at least two panels are used.

The panels of the inner most layer and/or outermost layer can be of different types, colors, texture, etc. Note that description herein in relation to the outermost layer may be applied instead, or in addition, to the innermost layer.

Figure 10:
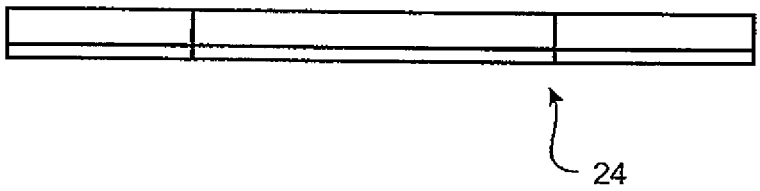
FIG. 10 shows a cross section view (through a location corresponding to A-A) of FIG. 3.

FIG. 10 is a cross sectional view of FIG. 3. The boundary 24 is shown to depict the point where two panels (in this case panels 12 and 13) are joined together.

Each of the panels of FIGS. 2 and 3 may be laminated with a foam layer 10. As shown on FIG. 9, the foam layer 10 is laminated to the panels of the outer most layer 11 such that they are coextensive with one another. The foam layer 10 may be of any suitable thickness and bonded to the fabric layer by any suitable means such as adhesive. Heat and pressure may be applied to facilitate the bonding. Whilst the foam layer 10 is present in the preferred embodiment of the invention, it is optional.

As an alternative to the preferred embodiment of the invention, the foam layer 10 may be unitary (not provided in panels) across the outer most layer 11. In such a configuration, the foam layer 10 is laminated to the outer most layer 11 after the panels of the outer most layer 11 are joined together.

Figure 4:
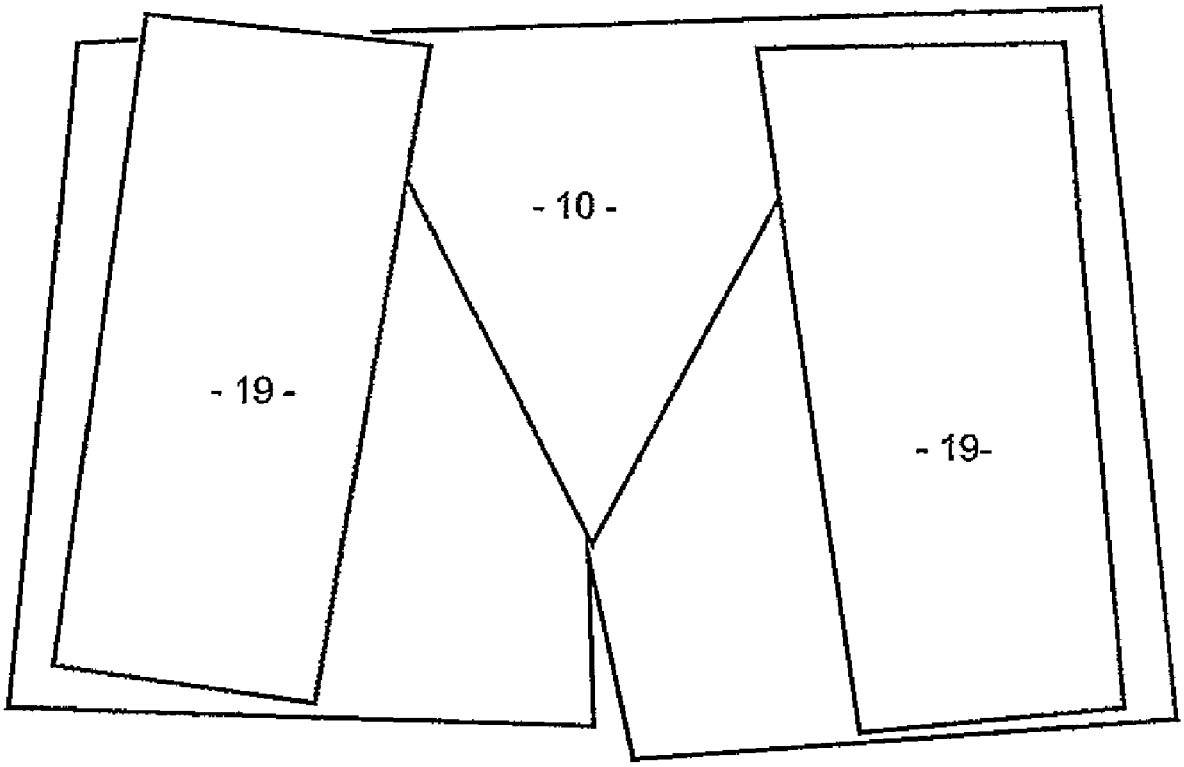
FIG. 4 is a view of the laminate with intermediate panels located thereon.
Figure 11:
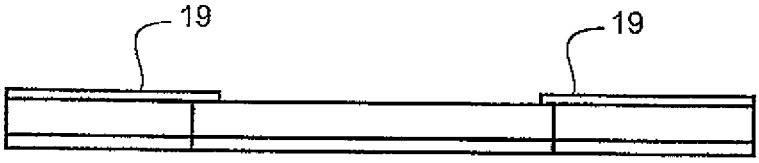
FIG. 11 shows a cross section view (through a location corresponding to A-A) of FIG. 4.

FIGS. 4 and 11 show two non-stretch or substantially non-stretch layers 19 located on top of the foam layer 10. The substantially non-stretch layers 19 preferably are of a size substantially corresponding to panels 12 and 14 of the outer most layer 11 if the outermost layer is defined by multiple panels. The substantially non-stretch layers are also preferably located such that their edge is substantially aligned with the boundary 24 (and the corresponding boundary between panels 13 and 14). Alternatively, the substantially non-stretch layers 19 may be slightly misaligned with the boundary 24, such as what is shown in FIG. 11.

Figure 5:
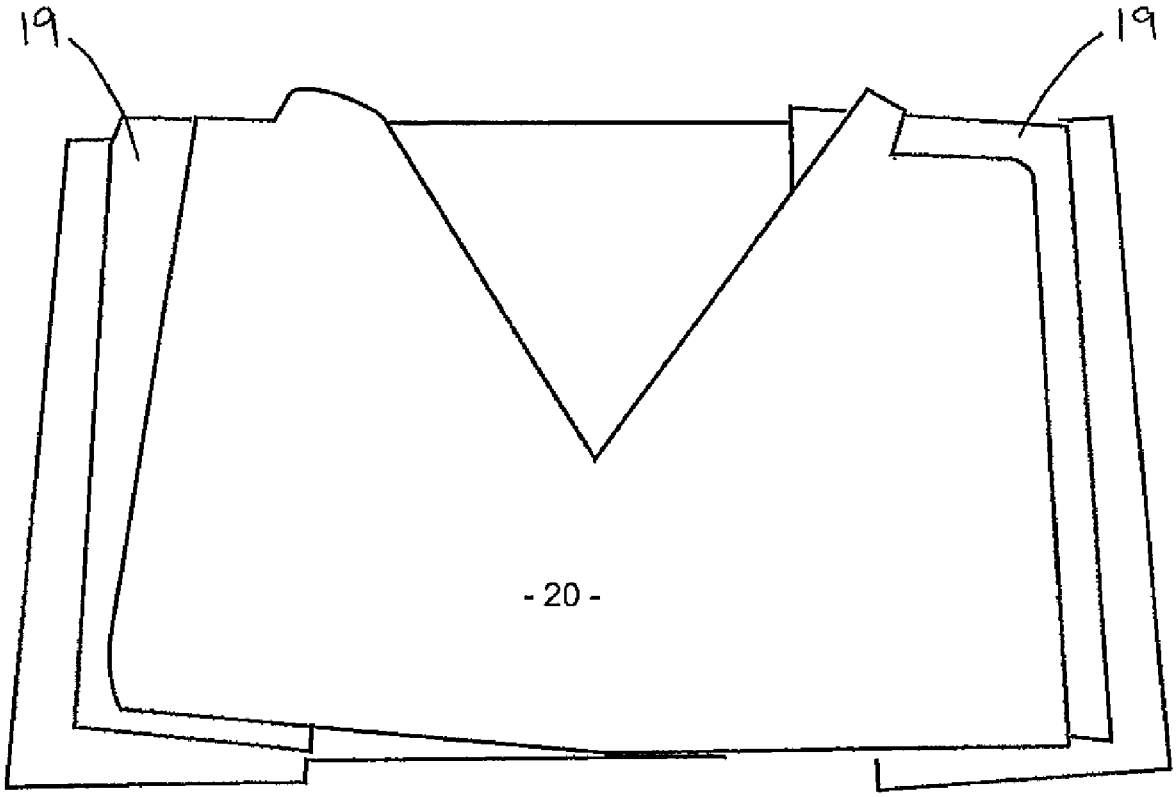
FIG. 5 is a view of the laminate with the second foam layer located thereon.
Figure 12:
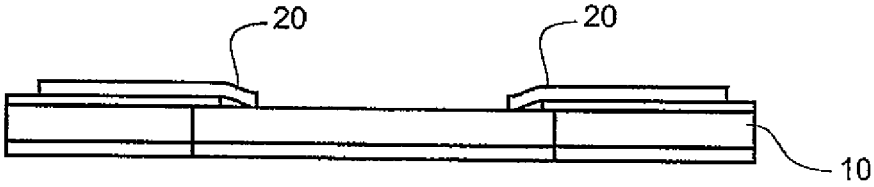
FIG. 12 shows a cross section view (through a location corresponding to A-A) of FIG. 5.

The substantially non-stretch layers may preferably be selected from a non-stretchable or substantially non stretchable fabric. Their purpose is to increase the "hardness" of the regions where they are present. FIG. 5 shows a second foam layer 20 laminated on top of the substantially non-stretch layers 19. As shown in FIG. 5 the foam layer 20 may have a rectangular shape with a triangular cut out from one of the edges. Preferably the triangular cut out corresponds to the boundaries where the panels of the outer most layer 11 are joined. However, they may be slightly misaligned as shown in FIG. 12.

The foam layer 20 may be of any suitable thickness and bonded to the substantially non-stretch layers 19 (and the foam layer 10, or fabric layer 11 underneath the substantially non-stretch layers) by any suitable means such as adhesive, possibly with heat and pressure applied. Whilst the foam layer 20 is present in the preferred embodiment of the invention, it is optional.

As an alternative to using the non-stretch or substantially non-stretch fabric layer 19, a foam layer may be used instead. This foam layer is generally harder than the foam layer 10 that is laminated to the outermost layer 11. Still alternatively, the increased hardness of a particular zone as compared with other zone(s) may be achieved by an increased thickness of the foam layer 10 or the second foam layer 20 at the place where increased hardness is desired.

Figure 6:
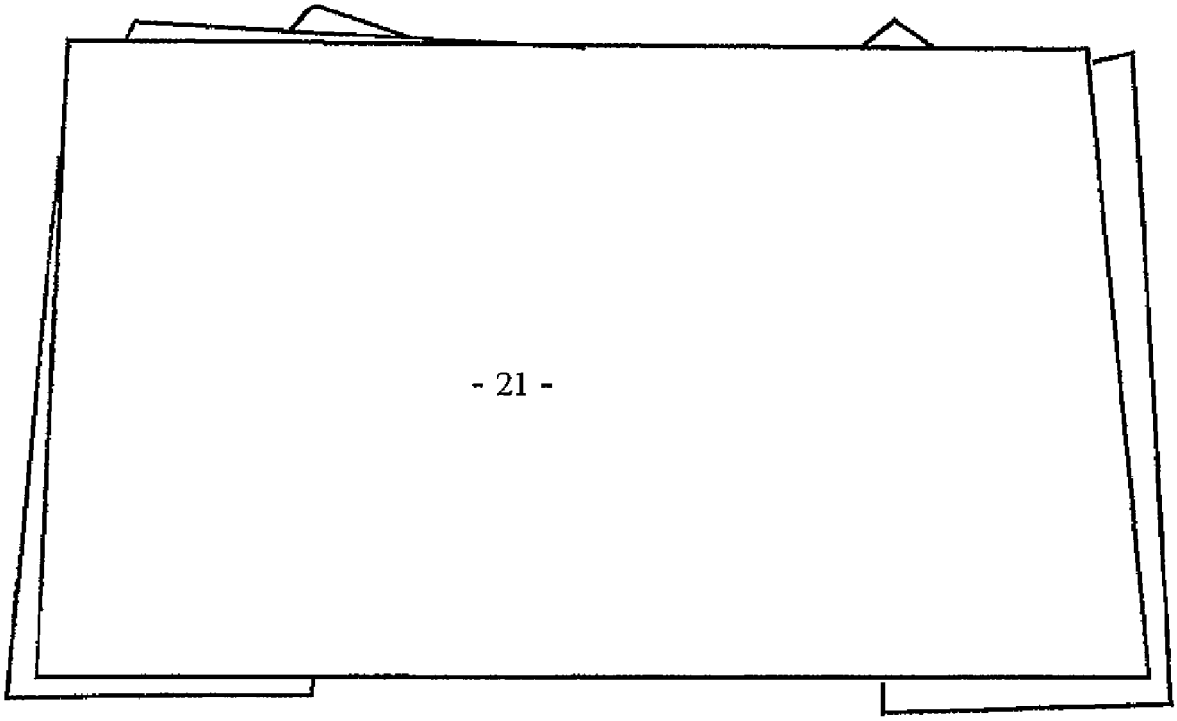
FIG. 6 is a view of the laminate with the inner most layer located thereon.
Figure 13:
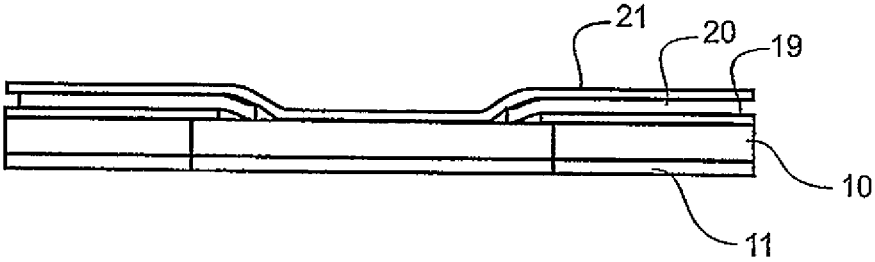
FIG. 13 shows a cross section view (through a location corresponding to A-A) of FIG. 6.

As shown in FIG. 6 and FIG. 13 the inner most layer 21 is laminated on top of the foam layer 20. The inner most layer 21 is preferably a unitary layer as shown but may alternatively comprise of multiple panels.

The inner most layer 21 is preferably a fabric layer, but may be any other suitable material. Preferably the inner most fabric layer is of the same material as the outer most fabric layer.

Figure 7:
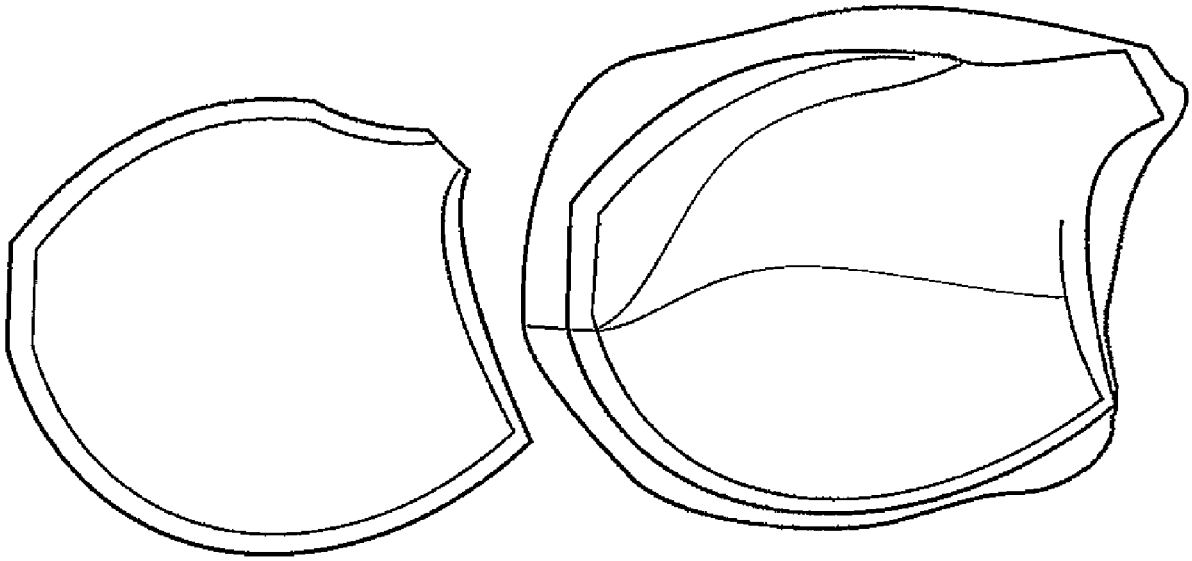
FIG. 7 shows two bra cups of the present invention which have been molded and cut.

The laminate of FIG. 6 may then be placed in a mold to produce the bra cups 2 and 3. FIG. 7 shows for example two bra cups which have been molded and cut.

Figure 8:
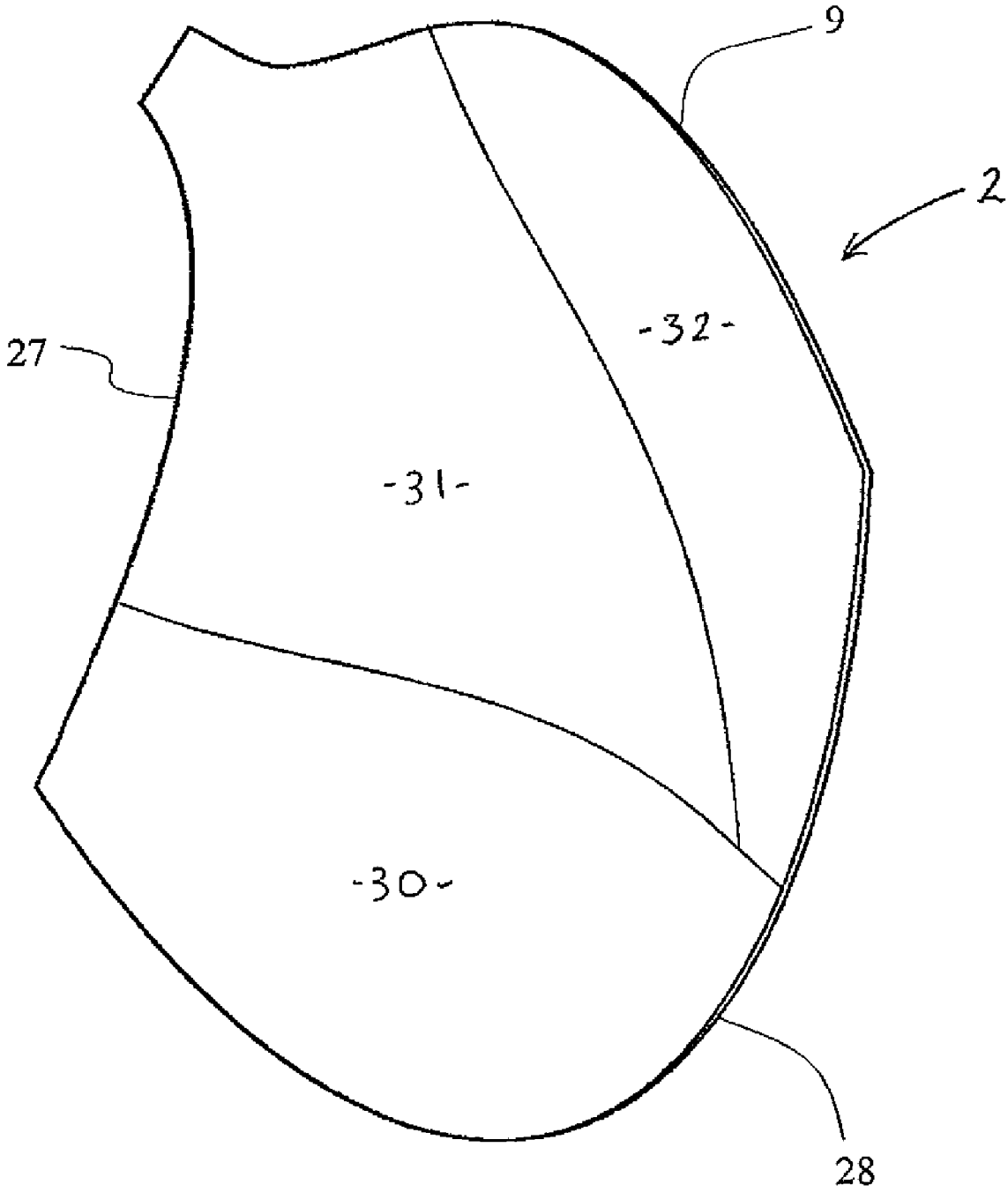
FIG. 8 shows a bra cup of the present invention which has been trimmed and shows the locations of the three zones as viewed from the inner side of the cup.
Figure 9:
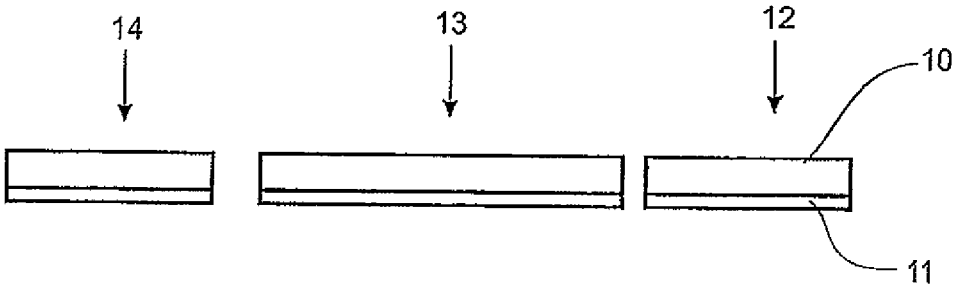
FIG. 9 shows a cross section view through A-A of FIG. 2.

FIG. 8 shows a bra cup 2 or 3 which has been trimmed. The cup may be trimmed for example by conventional cutting or ultrasonic cutting. The edges or part of the edges of the bra cup may also be "finished" by hemming, i.e., by affixing a folded-over portion of the outermost layer to the inner side of the innermost layer.

With reference to FIG. 8, where the bra cup is as seen from the inner side thereof and where the innermost layer of the bra cup is made up of multiple panels joined together, three zones 30, 31 and 32 are defined by the lines across the cup 2. The lines correspond with the boundary or joints between the adjacent panels of the innermost layer and/or outermost layer, and/or the edges of the substantially non-stretch layers 19 or second foam layer 20. The zones are a result of the different cross-sectional composition.

For example, in the preferred embodiment of the invention as illustrated in FIG. 8, zone 30 is the hardest zone which is adjacent most the base perimeter and which provides support to the breast, as a result of the layers of the laminate in that region. Zone 32 is for example the zone that is adjacent most the neckline perimeter and is next to the bridge region 8 between the two bra cups and has the softest hand feel—this is more comfortable to the breast at that region. Zone 31 is for example an intermediate region which has intermediate softness (harder than zone 32 but softer than zone 30). Its purpose is for example to narrow or lessen the difference between adjacent zones of different hand feel or elasticity.

With reference to the embodiment as shown in FIG. 8, the boundary between the hardest zone 30 and the intermediate zone 31 extends from the side perimeter 27 (as shown on the left-hand side in the figure) to the base perimeter 28 (as shown at the bottom in the figure), while the boundary between the intermediate zone 31 and the soft zone 32 extends between the neckline perimeter 9 (as shown on the upper right-hand side in the figure) and the base perimeter 28. The side perimeter 27 is that part of the perimeter of the bra cup which extends between the region where the shoulder strap is engaged to the bra cup and the region where the chest band is engaged to the bra cup. The base perimeter 28 is that part of the perimeter of the bra cup which extends from the lower end of the side perimeter 27 to the lower end of the neckline perimeter 9.

With reference to FIG. 8, it can also be seen that in this embodiment, a substantial part of the hardest zone 30 is adjacent the intermediate zone 31. Similarly, a substantial part of the soft zone 32 is adjacent the intermediate zone 31.

The different characteristics (i.e. due to elasticity, hardness of materials etc) of the zones 30, 31 and 32 is created as a result of the layer or assembly of layers of material captured between the outermost fabric layer 11 and the innermost fabric layer 21 of the bra cup (or of the breast cup region of a molded bra as the case may be). The captured assembly of layers of material may consist only of foam layer(s) or may consist of a combination of foam layer(s) and (for example) non-stretch or substantially non-stretch fabric layer.

The "lines" defining the zones 30, 31, and 32 are optional. If they are present, they preferably correspond roughly to the dividing lines or boundaries between adjacent zones of different characteristics, so that one can merely by looking at the bra cup know, by the presence of those lines, where the three different characterizing regions are located. If the "lines" are absent, the outermost and/or innermost fabric layer can for example be one continuous piece of fabric.

There are preferably three zones or regions of different characteristics, but there can be more or less than three zones, yet there will always be more than one zone.

The harder characteristic of a particular zone (as compared with the characteristic of a softer zone) is implemented through a harder foam layer or assembly of layers captured between the inner and outer most layers at that zone. For example, the harder characteristic of a particular zone could be the result of a harder foam layer (for example, the second foam layer 20 may be such a harder foam layer), or the result of a thicker foam layer being molded to the same or substantially the same resultant thickness as the foam layer of the other zones(s) (for example, the second foam layer 20 may be such a thicker foam layer), or the result of a non-stretch or substantially non-stretch fabric layer (for example 100% nylon or polyester) being captured within the assembly of layers (the substantially non-stretch layer 19 described herein is an example of this), or a combination of any of these. Preferably there is at least one foam layer in the captured assembly of layers.

The different zones can take any shapes, and can be located anywhere over the bra cup. As to possible locations of the different hand feel regions, it depends on the preference of the individual as to which location is softer and which other location(s) is/are harder. It should be appreciated that the shapes and locations of the zones as shown in the Figures are exemplary only and many other configurations are possible without departing from the scope of the invention.

The zones can be produced by a number of ways. For example, the boundaries between the panels on the inner fabric layer or on the outer fabric or on both the inner and outer fabric layers can define the zones. Additionally, the layering of substantially non-stretch layers 19, and foam layer 20 can define the different zones.

With reference to the preferred embodiment shown in FIG. 8, the reason why zone 32 may require a softer feel (and elasticity) is because it improves the flexibility or compatibility of a bra of a certain size (for example, 34A, 36B, etc.) to fit slight variations in body sizes not large enough to fit the next available bra size. If zone 32 or the neckline is too rigid, such flexibility or compatibility will be reduced.

On the other hand, zone 30 should essentially be (though not absolutely) rigid and not elastic in order to provide the necessary support to the breast.

The three-zone embodiment is the most preferred embodiment. In such an embodiment, the intermediate zone 31 may act as a "buffer or transitional zone" between the hard zone 30 and the softer zone 32. If the buffer zone is absent, the substantial difference in elasticity and hardness characteristics between the hard and soft zones could cause an abrupt splitting of the breast shape into two portions, one being substantially following the shape of the substantially rigid and non-elastic hard zone while the other portion is to a certain extent enlarged through the other substantially softer and more elastic zone.

The fabric material or some of the fabric material used may be of a material known by model number CMF-7440MU of Friendly Foundate Ltd. This fabric is made of 80% Tactel and 20% lycra. The fabric layers 11 and 21 may have a make-up of approximately 80% Tactel 40d/34f and 20% lycra 40d and of a weight of, for example, 190 g/m2.

The foam used is preferably a polyurethane foam of a precursor density of, for example, 30-40 kg/m$^3$.

Adhesive used may be of a kind such as RM-30 of Ultra Energy Adhesive Trading Co., Ltd.

The non-stretch layer 19 may be 7118 of Goldspring Co. Ltd. It is preferably a piece of gauze which is 100% nylon or polyester.

One or all the molding processes occur preferably at an upper mold temperature of 180° C. to 200° C. and the lower mold is preferably of 180° C. to 200° C. The dwell time holding the mold portions together is for example 120 seconds.

More specifically, the foam hardness and density for a foam layer implementing varying degrees of hardness may be as follows:

For the "hardest" zone 30:
Hardness: 70-90 N/314 cm$^2$
Density: 45-55 kg/m$^3$
For the "intermediate" zone 31:
Hardness: 40-60 N/314 cm$^2$
Density: 30-45 kg/m$^3$
For the "soft" zone 32:
Hardness: 18-28 N/314 cm$^2$
Density: 30-40 kg/m$^3$ Preferred foam thickness for a polyurethane foam layer for implementing varying degrees of hardness may be as follows:

For the "hard" zone 30:
Thickness before molding: 20 mm
Thickness after molding: 6 mm
For the "intermediate" zone 31:
Thickness before molding: 10-16 mm
Thickness after molding: 6 mm
For the "soft" zone 32:
Thickness before molding: 5-6 mm
Thickness after molding: 4-5 mm The thickness after molding here refers to the thickness over the major portion of a zone excluding the portion (if any) at or close to the edge of the bra cup, since at or close to the edge of the bra cup the molded thickness will be reduced.

While the present invention has been described with reference to particular embodiments thereof, it will be understood that such embodiments are susceptible of modifications and variations without departing from the scope of the present invention and that the invention will include all embodiments falling within the scope of the appended claims.

The invention claimed is:

1. A bra that includes two breast cups, each of the breast cups having a perimeter and including an outermost layer and an innermost layer, wherein: (i) at at least one breast cup, at least one intermediate panel is captured between the innermost layer and the outermost layer, and at least part of an edge of the intermediate panel is positioned at a location that is non-contiguous the perimeter of the cup to define within the cup perimeter at least two zones of different cross sectional composition; and (ii) at least one of the outermost and innermost layers comprises at least two panels that correspond to the at least two zones of the at least one breast cup.

2. A bra as claimed in claim 1 wherein at least the perimeter of the at least one breast cup is defined at least by one of the outermost layer and innermost layer.

3. A bra as claimed in claim 1 wherein the innermost layer is laminated to a foam layer that is proximate more the outermost layer than the innermost layer.

4. A bra as claimed in claim 3 wherein the innermost layer and foam layer are coextensive.

5. A bra as claimed in claim 3 wherein each of the innermost layer and the foam layer with which the innermost layer is laminated comprises at least two panels that define a boundary between said two panels, the boundary at least in part corresponds to at least part of a boundary between the at least two zones of different cross sectional composition.

6. A bra as claimed in claim 3 wherein the first mentioned foam layer is laminated to the outermost layer at regions save for where the intermediate panel is located.

7. A bra as claimed in claim 1 wherein the outermost layer is laminated to a foam layer that is proximate more the innermost layer than the outermost layer.

8. A bra as claimed in claim 7 wherein the outermost layer and the foam layer laminated to the outermost layer are coextensive.

9. A bra as claimed in claim 7 wherein the second mentioned foam layer is laminated to the innermost layer at regions save for where the intermediate panel is located.

10. A bra as claimed in claim 7 wherein each of the outermost layer and the foam layer with which the outermost layer is laminated comprises at least two panels that define a boundary between said two panels, the boundary at least in part corresponds to at least part of a boundary between the at least two zones of different cross sectional composition.

11. A bra as claimed in claim 1 wherein the innermost layer is laminated to the outermost layer at regions save for where the intermediate panel is located.

12. A bra as claimed in claim 1 wherein the at least one breast cup has a neckline perimeter, a side perimeter, and a base perimeter, and the at least part of an edge of the intermediate panel extends at least one of between, to and from the neckline perimeter and the side perimeter.

13. A bra as claimed in claim 12 wherein the at least one breast cup has a lower region and an upper region, the lower region being harder than the upper region.

14. A bra as claimed in claim 13 wherein the lower region extends from the base perimeter towards the neckline perimeter.

15. A bra as claimed in claim 13 wherein the upper region extends from the neckline perimeter towards the base perimeter.

16. A bra as claimed in claim 13 wherein the at least one breast cup has an intermediate region, the intermediate region having a hardness that is intermediate that of the hardness of the upper region and the hardness of the lower region.

17. A bra as claimed in claim 16 wherein the intermediate region completely separates the upper region and lower region.

18. A bra as claimed in claim 16 wherein the intermediate region extends from the side perimeter.

19. A bra as claimed in claim 1 wherein the at least part of an edge of the intermediate layer extends at least one of between, to and from the neckline perimeter and the base perimeter.

20. A bra as claimed in claim 1 wherein the at least part of an edge of the intermediate layer extends at least one of between, to and from the side perimeter and the base perimeter.

21. A bra as claimed in claim 1 wherein the at least two panels are at least in part joined to each other by ultrasonic welding.

22. A bra as claimed in claim 1 wherein the at least two panels define a boundary between said two panels, the boundary at least in part corresponds to at least part of a boundary between the at least two zones of different cross sectional composition.

23. A bra as claimed in claim 1 wherein the at least two panels define a boundary between said two panels, the boundary corresponds to a boundary between the at least two zones.

24. A bra as claimed in claim 1 wherein the innermost layer and outermost layer are coextensive with each other.

25. A bra as claimed in claim 1 wherein the innermost layer is a fabric layer.

26. A bra as claimed in claim 1 wherein the outermost layer is a fabric layer.

27. A bra as claimed in claim 1 wherein the intermediate panel is a panel of a material selected from one of foam, fabric and polyolefin.

28. A bra as claimed in claim 1 wherein each of the at least two panels is of a different characteristic from the other, the different characteristic comprising at least one of:

shape, thickness, material, composition, construction, color, texture, profile and density.

29. A bra as claimed in claim 1 wherein there are at least two intermediate panels.

30. A bra as claimed in claim 29 wherein the at least two intermediate panels do not overlap each other.

31. A bra as claimed in claim 29 wherein each of the at least two intermediate panels is of a different characteristic from the other, the different characteristic comprising at least one of: shape, thickness, material, composition, construction, color, texture, profile and density.

32. A bra of claim 1 wherein the intermediate panel comprises a ply of foam having a perimeter, the ply of foam having a thin perimeter region at least part of the perimeter, the thin perimeter region being of a reduced thickness compared to the rest of the ply.

33. A bra of claim 1 wherein the intermediate panel is a non-stretch fabric.

34. A bra of claim 1 wherein the intermediate panel comprises a non-stretch fabric.

35. A bra of claim 1 wherein the bra is a molded bra.

36. A bra of claim 1 wherein the bra is a seamless bra.

37. A breast cup for a bra, said breast cup having a perimeter and comprising an outermost layer and an innermost layer and at least one intermediate panel that is captured between the innermost layer and the outermost layer, wherein: (i) at least part of an edge of the intermediate panel is positioned at a location that is non-contiguous the perimeter of the cup to define within the cup perimeter at least two zones of different cross sectional composition; and (ii) at least one of the outermost and innermost layers comprises a plurality of panels joined together.

38. A method of producing a breast cup for a bra, wherein the breast cup has a perimeter and the method comprises the steps of:

providing an outermost layer, providing an innermost layer, and capturing an intermediate panel between the outermost layer and the innermost layer, the intermediate panel captured such that at least part of an edge of the intermediate panel is positioned at a location that is non-contiguous the perimeter of the breast cup so that at least two zones of different cross sectional compositions are defined within the perimeter of the breast cup, wherein at least one of the outermost and innermost layers is formed from a plurality of panels joined together.

39. The method of claim 38 wherein prior to or at the time of capturing the intermediate panel, the innermost layer is laminated to a foam layer that is to be positioned adjacent the intermediate panel.

40. The method of claim 38 wherein the outermost layer and innermost layer are shaped and positioned to be coextensive each other.

41. The method of claim 38 wherein the joining of the plurality of panels is by ultrasonic welding.

42. The method of claim 38 wherein a boundary between two of said panels joined together at least in part corresponds to at least part of a boundary between the two zones of different cross sectional composition.

43. The method of claim 39 wherein the innermost layer and the foam layer are coextensive.

44. The method of claim 39 wherein prior to or at the time of capturing the intermediate panel, the outermost layer is laminated to a second foam layer.

* * * * *

UNITED STATES PATENT AND TRADEMARK OFFICE

CERTIFICATE OF CORRECTION

PATENT NO. : 8,388,406 B2
APPLICATION NO. : 12/202668
DATED : March 5, 2013
INVENTOR(S) : Zhen Qiang Liu It is certified that error appears in the above-identified patent and that said Letters Patent is hereby corrected as shown below:

Title Page, item [54] and in the Specification, column 1, Title: "-BRASSIERES-" should be changed to "--IMPROVEMENTS TO BRASSIERES--".

In the Claims:

Claim 32, column 12, line 12: "-having a thin perimeter region at least part of the perimeter-" should be changed to "--having a thin perimeter region at at least part of the perimeter--".

Signed and Sealed this
Twenty-first Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,388,406 B2
APPLICATION NO. : 12/202668
DATED : March 5, 2013
INVENTOR(S) : Zhen Qiang Liu It is certified that error appears in the above-identified patent and that said Letters Patent is hereby corrected as shown below:

Title Page,

Item [54], Title, and in the Specifications, column 1, line 1, the words "IMPROVEMENTS TO" (as inserted by the Certificate of Correction issued May 21, 2013) should be deleted and title is reinstated to read -- BRASSIERES --.

Signed and Sealed this
Eleventh Day of June, 2013

Teresa Stanek Rea
*Acting Director of the United States Patent and Trademark Office*